US011034912B2

(12) United States Patent
Ritchie et al.

(10) Patent No.: US 11,034,912 B2
(45) Date of Patent: Jun. 15, 2021

(54) LUBRICATING OIL COMPOSITIONS

(71) Applicant: Infineum International Limited, Abingdon (GB)

(72) Inventors: Andrew J. D. Ritchie, Chatham, NJ (US); Doyle Boese, Plainfield, NJ (US); Jose A. Gutierrez, Fanwood, NJ (US)

(73) Assignee: Infineum International Limited

( * ) Notice: Subject to any disclaimer, the term of this patent is extended or adjusted under 35 U.S.C. 154(b) by 0 days.

(21) Appl. No.: 14/264,154

(22) Filed: Apr. 29, 2014

(65) Prior Publication Data

US 2015/0307802 A1 Oct. 29, 2015

(51) Int. Cl.
*C10M 171/00* (2006.01)
*C10M 169/04* (2006.01)
(Continued)

(52) U.S. Cl.
CPC ..... *C10M 171/00* (2013.01); *C10M 169/04* (2013.01); *C10M 2201/05* (2013.01); *C10M 2201/084* (2013.01); *C10M 2207/023* (2013.01); *C10M 2207/028* (2013.01); *C10M 2207/141* (2013.01); *C10M 2207/142* (2013.01); *C10M 2207/144* (2013.01); *C10M 2207/262* (2013.01); *C10M 2219/044* (2013.01); *C10M 2219/046* (2013.01); *C10M 2223/045* (2013.01); *C10N 2010/04* (2013.01); *C10N 2010/12* (2013.01); *C10N 2030/00* (2013.01);
(Continued)

(58) Field of Classification Search
CPC ..... C10M 169/04; C10M 2207/023; C10M 2207/028; C10M 2207/141; C10M 2207/142; C10M 2207/144; C10M 2207/262; C10M 2219/044; C10M 2219/046; C10M 2223/045; C10N 2010/04; C10N 2010/12; C10N 2030/00; C10N 2030/25; C10N 2030/45; C10N 2040/255
USPC ..... 508/151
See application file for complete search history.

(56) References Cited

U.S. PATENT DOCUMENTS 4,285,822 A * 8/1981 deVries et al. ..... 508/230
4,941,984 A 7/1990 Chamberlin, III et al.
(Continued)

FOREIGN PATENT DOCUMENTS

EP 1788068 A1 5/2007
EP 2639433 A1 9/2013
(Continued)

OTHER PUBLICATIONS

Takeuchi et al., Investigation of Engine Oil Effect on Abnormal Combustion in Turbocharged Direct Injection-Spark Ignition Engines, SAE Int., Nov. 2012, vol. 5, Issue 3.
(Continued)

*Primary Examiner* — James C Goloboy

(57) ABSTRACT

A method of preventing or reducing the occurrence of Low Speed Pre-Ignition (LSPI) in a direct-injected, boosted, spark-ignited internal combustion engine that, in operation, generates a break mean effective pressure level of greater than about 15 bar, at an engine speed of from about 1500 to about 2500 rotations per minute (rpm), in which the crankcase of the engine is lubricated with a lubricating oil composition containing at least about 0.2 mass % of magnesium sulfated ash.

6 Claims, 3 Drawing Sheets

(51) Int. Cl.

| | |
|---|---|
| ***C10N 10/04*** | (2006.01) |
| ***C10N 10/12*** | (2006.01) |
| ***C10N 30/00*** | (2006.01) |
| ***C10N 40/25*** | (2006.01) |

(52) U.S. Cl.
CPC ..... *C10N 2030/45* (2020.05); *C10N 2040/25* (2013.01); *C10N 2040/255* (2020.05)

(56) References Cited

U.S. PATENT DOCUMENTS

| | | | | |
|---|---|---|---|---|
| 8,260,530 | B2 | 9/2012 | Rollinger et al. | |
| 8,327,687 | B2 | 12/2012 | Amann et al. | |
| 8,543,315 | B2 | 9/2013 | Glugla et al. | |
| 2011/0111997 | A1* | 5/2011 | Cook et al. | 508/563 |
| 2011/0213538 | A1 | 9/2011 | Amann et al. | |
| 2011/0265761 | A1 | 11/2011 | Amann et al. | |
| 2012/0029789 | A1 | 2/2012 | Mehta et al. | |
| 2012/0186225 | A1* | 7/2012 | Amann et al. | 60/274 |
| 2013/0035841 | A1 | 2/2013 | Glugla et al. | |
| 2015/0322367 | A1 | 11/2015 | Patel et al. | |
| 2016/0230116 | A1* | 8/2016 | Mosier | C10M 163/00 |
| 2017/0015930 | A1* | 1/2017 | Fletcher | C10M 163/00 |
| 2017/0022441 | A1* | 1/2017 | Onodera | C10M 141/12 |

FOREIGN PATENT DOCUMENTS

| | | | |
|---|---|---|---|
| JP | 2014152301 | A | 8/2014 |
| WO | WO-2015023559 | A1 | 2/2015 |
| WO | 2015042340 | A1 † | 3/2015 |
| WO | WO-2015042337 | A1 | 3/2015 |
| WO | WO-2015042340 | A1 | 3/2015 |
| WO | WO-2015042341 | A1 | 3/2015 |
| WO | WO-2015076417 | A1 | 5/2015 |
| WO | WO-20150114920 | A1 | 8/2015 |

OTHER PUBLICATIONS

Haenel et al., Systematic Approach to Analyze and Characterize Pre-ignition Events in Turbocharged Direct-injected Gasoline Engines, SAE Int., Apr. 2011.

Office Action published Dec. 17, 2015 issued in U.S. Appl. No. 14/706,161; United States Patent and Trademark Office.†

* cited by examiner
† cited by third party

LUBRICATING OIL COMPOSITIONS

The present invention relates to a method of reducing the occurrence of Low Speed Pre-Ignition (LSPI) in high output, spark ignited internal combustions engines, in which a lubricating oil composition having a defined metals content is used to lubricate the engine crankcase, and lubricating oil compositions having a defined metals content found to reduce the occurrence of LSPI in high output, spark ignited internal combustions engines.

BACKGROUND OF THE INVENTION

Market demand, as well as governmental legislation, has led automotive manufacturers to continuously improve fuel economy and reduce $CO_2$ emissions across engine families, while simultaneously maintaining performance (horsepower). Using smaller engines providing higher power densities, increasing boost pressure, by using turbochargers or superchargers to increase specific output and downspeeding the engine by using higher transmission gear ratios allowed by higher torque generation at lower engine speeds have allowed engine manufacturers to provide excellent performance while reducing frictional and pumping losses. However, higher torque at lower engine speeds has been found to cause random pre-ignition in engines at low speeds, a phenomenon known as Low Speed Pre-Ignition, or LSPI, resulting in extremely high cylinder peak pressures, which can lead to catastrophic engine failure. The possibility of LSPI prevents engine manufacturers from fully optimizing engine torque at lower engine speed in such smaller, high-output engines.

While not wishing to be bound by any specific theory, it is believed that LSPI may be caused, at least in part, by auto-ignition of engine oil droplets that enter the engine combustion chamber from the piston crevice (space between the piston ring pack and cylinder liner) under high pressure, during periods in which the engine is operating at low speeds, and compression stroke time is longest (e.g., an engine having a 7.5 msec compression stroke at 4000 rpm may have a 24 msec compression stroke when operating at 1250 rpm). Therefore, it would be advantageous to identify and provide lubricating oil compositions that are resistant to auto-ignition and therefore prevent or ameliorate the occurrence of LSPI.

SUMMARY OF THE INVENTION

In accordance with a first aspect of the invention, there is provided a method of preventing or reducing the occurrence of Low Speed Pre-Ignition (LSPI) in a direct-injected, boosted (turbocharged or supercharged), spark-ignited (gasoline) internal combustion that, in operation, generates a break mean effective pressure level of greater than about 15 bar (peak torque), at an engine speed of from about 1500 to about 2500 rotations per minute (rpm), which method comprises the step of lubricating the crankcase of the engine with a lubricating oil composition containing at least about 0.2 mass % of magnesium, based on the total mass of the lubricating oil composition, calculated as sulfated ash (SASH).

In accordance with a second aspect of the invention, there is provided a method, as in the first aspect, wherein lubricating oil composition further contains an amount of phosphorus within 100 ppm of the maximum amount of phosphorus allowed by industry standards (for passenger car motor oils (PCMO)), presently 800 ppm max., based on the total mass of the lubricating oil composition).

In accordance with a third aspect of the invention, there is provided a method, as in the first or second aspect, wherein the lubricating oil composition contains less than 0.4 mass % of calcium, based on the total mass of the lubricating oil composition, calculated as sulfated ash (SASH).

In accordance with a fourth aspect of the invention, there is provided a method, as in the first, second or third aspect, wherein the lubricating oil composition contains at least 50 ppm of molybdenum, based on the total mass of the lubricating oil composition.

A fifth aspect of the invention is directed to the use of lubricating oil composition containing at least about 0.2 mass % of magnesium, based on the total mass of the lubricating oil composition, calculated as sulfated ash, to prevent or reduce the occurrence of Low Speed Pre-Ignition (LSPI) in direct-injected, boosted (turbocharged or supercharged), spark-ignited (gasoline), internal combustion that, in operation, generates a break mean effective pressure level of greater than about 15 bar (peak torque), at an engine speed of from about 1500 to about 2500 rotations per minute (rpm).

Other and further objects, advantages and features of the present invention will be understood by reference to the following specification.

DETAILED DESCRIPTION OF THE INVENTION

Figure 1:
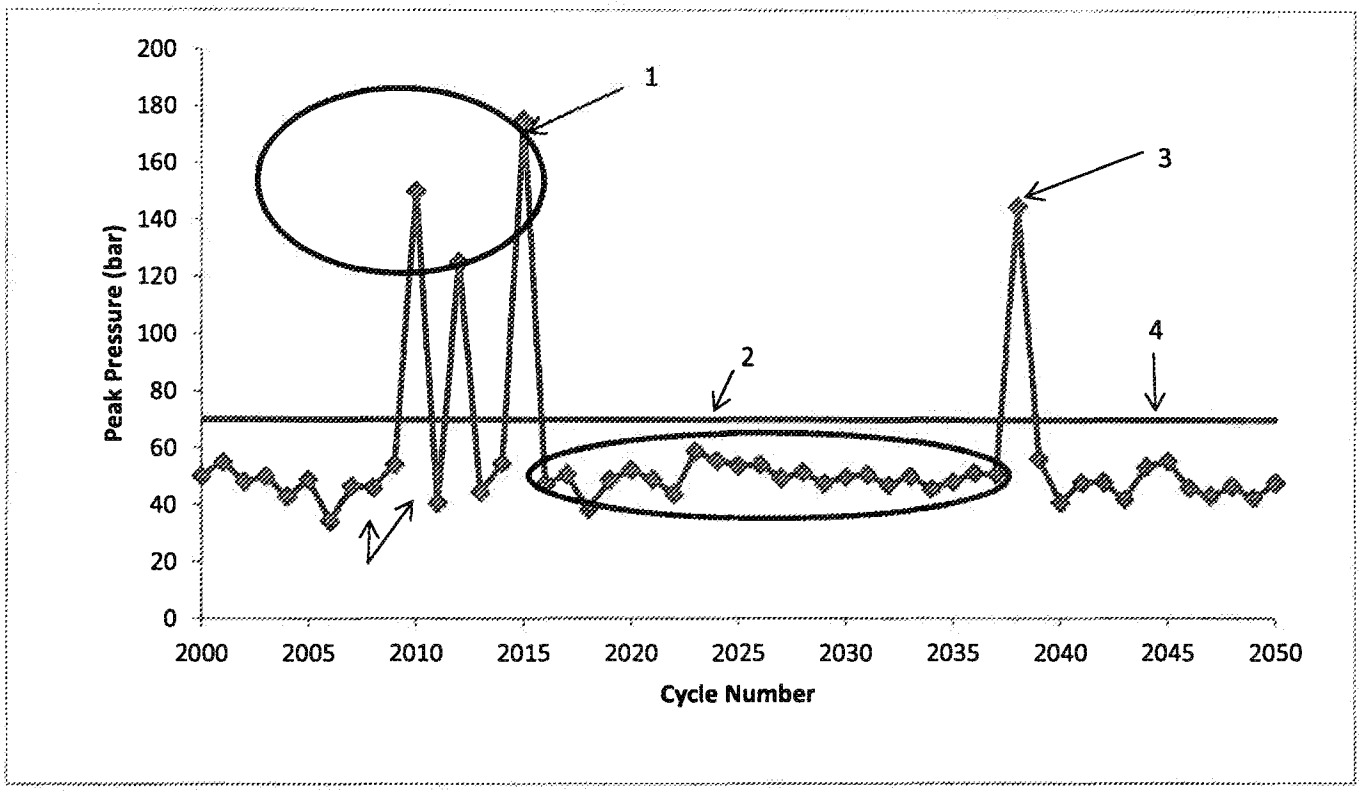
FIG. 1 shows graphically the occurrence of LSPI events in an engine, in accordance with the method of determining the occurrence of LSPI events as used in the Examples of the present Specification.

Several terms exist for various forms of abnormal combustion in spark ignited internal combustion engines including knock, extreme knock (sometimes referred to as superknock or mega-knock), surface ignition, and pre-ignition (ignition occurring prior to spark ignition). Extreme knock occurs in the same manner as traditional knock, but with increased knock amplitude, and can be mitigated using traditional knock control methods. LSPI usually occurs at low speeds and high loads. In LSPI, initial combustion is relatively slow and similar to normal combustion, followed by a sudden increase in combustion speed. LSPI is not a runaway phenomenon, unlike some other types of abnormal combustion. Occurrences of LSPI are difficult to predict, but are often cyclical in nature Low Speed Pre-Ignition (LSPI) is most likely to occur in direct-injected, boosted (turbocharged or supercharged), spark-ignited (gasoline) internal combustion that, in operation, generate a break mean effective pressure level of greater than about 15 bar (peak torque), such as at least about 18 bar, particularly at least about 20 bar at engine speeds of from about 1500 to about 2500 rotations per minute (rpm), such as at engine speeds of from about 1500 to about 2000 rpm. As used herein, break mean effective pressure (BMEP) is defined as the work accomplished during on engine cycle, divided by the engine swept volume; the engine torque normalized by engine displacement. The word "brake" denotes the actual torque/power available at the engine flywheel, as measured on a dynamometer. Thus, BMEP is a measure of the useful power output of the engine.

It has now been found that the occurrence of LSPI in engines susceptible to the occurrence of LSPI can be reduced by lubricating such engines with lubricating oil compositions containing at least about 0.2 mass % of magnesium, based on the total mass of the lubricating oil composition, expressed as magnesium sulfated ash.

Lubricating oil compositions suitable for use as passenger car motor oils conventionally comprise a major amount of oil of lubricating viscosity and minor amounts of performance enhancing additives, including ash-containing detergents. Conveniently, magnesium is introduced into the lubricating oil compositions used in the practice of the present invention by one or more magnesium-based detergents, such as one or more magnesium sulfonate detergent, one or more magnesium salicylate detergent, or a mixture thereof. Preferably, such magnesium-based detergents are overbased magnesium detergents.

The oil of lubricating viscosity useful in the formulation of lubricating oil compositions suitable for use in the practice of the invention may range in viscosity from light distillate mineral oils to heavy lubricating oils such as gasoline engine oils, mineral lubricating oils and heavy duty diesel oils. Generally, the viscosity of the oil ranges from about 2 $mm^2$/sec (centistokes) to about 40 $mm^2$/sec, especially from about 3 $mm^2$/sec to about 20 $mm^2$/sec, most preferably from about 9 $mm^2$/sec to about 17 $mm^2$/sec, measured at 100° C.

Natural oils include animal oils and vegetable oils (e.g., castor oil, lard oil); liquid petroleum oils and hydrorefined, solvent-treated or acid-treated mineral oils of the paraffinic, naphthenic and mixed paraffinic-naphthenic types. Oils of lubricating viscosity derived from coal or shale also serve as useful base oils.

Synthetic lubricating oils include hydrocarbon oils and halo-substituted hydrocarbon oils such as polymerized and interpolymerized olefins (e.g., polybutylenes, polypropylenes, propylene-isobutylene copolymers, chlorinated polybutylenes, poly(1-hexenes), poly(1-octenes), poly(1-decenes)); alkylbenzenes (e.g., dodecylbenzenes, tetradecylbenzenes, dinonylbenzenes, di(2-ethylhexyl)benzenes); polyphenyls (e.g., biphenyls, terphenyls, alkylated polyphenols); and alkylated diphenyl ethers and alkylated diphenyl sulfides and derivative, analogs and homologs thereof.

Alkylene oxide polymers and interpolymers and derivatives thereof where the terminal hydroxyl groups have been modified by esterification, etherification, etc., constitute another class of known synthetic lubricating oils. These are exemplified by polyoxyalkylene polymers prepared by polymerization of ethylene oxide or propylene oxide, and the alkyl and aryl ethers of polyoxyalkylene polymers (e.g., methyl-polyiso-propylene glycol ether having a molecular weight of 1000 or diphenyl ether of poly-ethylene glycol having a molecular weight of 1000 to 1500); and mono- and polycarboxylic esters thereof, for example, the acetic acid esters, mixed $C_3$-$C_8$ fatty acid esters and $C_{13}$ Oxo acid diester of tetraethylene glycol.

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols (e.g., butyl alcohol, hexyl alcohol, dodecyl alcohol, 2-ethylhexyl alcohol, ethylene glycol, diethylene glycol monoether, propylene glycol). Specific examples of such esters includes dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. Also useful are synthetic oils derived from a gas to liquid process from Fischer-Tropsch synthesized hydrocarbons, which are commonly referred to as gas to liquid, or "GTL" base oils.

Esters useful as synthetic oils also include those made from $C_5$ to $C_{12}$ monocarboxylic acids and polyols and polyol esters such as neopentyl glycol, trimethylolpropane, pentaerythritol, dipentaerythritol and tripentaerythritol.

Silicon-based oils such as the polyalkyl-, polyaryl-, polyalkoxy- or polyaryloxysilicone oils and silicate oils comprise another useful class of synthetic lubricants; such oils include tetraethyl silicate, tetraisopropyl silicate, tetra-(2-ethylhexyl)silicate, tetra-(4-methyl-2-ethylhexyl)silicate, tetra-(p-tert-butyl-phenyl)silicate, hexa-(4-methyl-2-ethylhexyl)disiloxane, poly(methyl)siloxanes and poly(methylphenyl)siloxanes. Other synthetic lubricating oils include liquid esters of phosphorous-containing acids (e.g., tricresyl phosphate, trioctyl phosphate, diethyl ester of decylphosphonic acid) and polymeric tetrahydrofurans.

The oil of lubricating viscosity may comprise a Group I, Group II, Group III, Group IV or Group V base stocks or base oil blends of the aforementioned base stocks. Preferably, the oil of lubricating viscosity is a Group II, Group III, Group IV or Group V base stock, or a mixture thereof, or a mixture of a Group I base stock and one or more a Group II, Group III, Group IV or Group V base stock. The base stock, or base stock blend preferably has a saturate content of at least 65%, more preferably at least 75%, such as at least 85%. Preferably, the base stock or base stock blend is a Group III or higher base stock or mixture thereof, or a mixture of a Group II base stock and a Group III or higher base stock or mixture thereof. Most preferably, the base stock, or base stock blend, has a saturate content of greater than 90%. Preferably, the oil or oil blend will have a sulfur content of less than 1 mass %, preferably less than 0.6 mass %, most preferably less than 0.4 mass %, such as less than 0.3 mass %. Group III base stock has been found to provide a wear credit relative to Group I base stock. Therefore, in one preferred embodiment, at least 30 mass %, preferably at least 50 mass %, more preferably at least 80 mass % of the oil of lubricating viscosity used in lubricating oil compositions of the present invention is Group 3 base stock.

Preferably the volatility of the oil or oil blend, as measured by the Noack test (ASTM D5800), is less than or equal to 30 mass %, such as less than about 25 mass %, preferably less than or equal to 20 mass %, more preferably less than or equal to 15 mass %, most preferably less than or equal 13 mass %. Preferably, the viscosity index (VI) of the oil or oil blend is at least 85, preferably at least 100, most preferably from about 105 to 140.

Definitions for the base stocks and base oils in this invention are the same as those found in the American Petroleum Institute (API) publication "Engine Oil Licensing and Certification System", Industry Services Department, Fourteenth Edition, December 1996, Addendum 1, December 1998. Said publication categorizes base stocks as follows:

a) Group I base stocks contain less than 90 percent saturates and/or greater than 0.03 percent sulfur and have a viscosity index greater than or equal to 80 and less than 120 using the test methods specified in Table 1.
b) Group II base stocks contain greater than or equal to 90 percent saturates and less than or equal to 0.03 percent sulfur and have a viscosity index greater than or equal to 80 and less than 120 using the test methods specified in Table 1.
c) Group III base stocks contain greater than or equal to 90 percent saturates and less than or equal to 0.03 percent sulfur and have a viscosity index greater than or equal to 120 using the test methods specified in Table 1.
d) Group IV base stocks are polyalphaolefins (PAO).
e) Group V base stocks include all other base stocks not included in Group I, II, III, or IV.

TABLE 1

Analytical Methods for Base Stock

| Property | Test Method |
|---|---|
| Saturates | ASTM D 2007 |
| Viscosity Index | ASTM D 2270 |
| Sulfur | ASTM D 2622; ASTM D 4294; ASTM D 4927; ASTM D 3120 |

Metal-containing or ash-forming detergents function as both detergents to reduce or remove deposits and as acid neutralizers or rust inhibitors, thereby reducing wear and corrosion and extending engine life. Detergents generally comprise a polar head with a long hydrophobic tail. The polar head comprises a metal salt of an acidic organic compound. The salts may contain a substantially stoichiometric amount of the metal in which case they are usually described as normal or neutral salts, and have a total base number or TBN (as can be measured by ASTM D2896) of from 0 to less than 150, such as 0 to about 80 or 100. A large amount of a metal base may be incorporated by reacting excess metal compound (e.g., an oxide or hydroxide) with an acidic gas (e.g., carbon dioxide). The resulting overbased detergent comprises neutralized detergent as the outer layer of a metal base (e.g. carbonate) micelle. Such overbased detergents have a TBN of 150 or greater, and typically will have a TBN of from 250 to 450 or more.

Detergents that may be used include oil-soluble neutral and overbased sulfonates, phenates, sulfurized phenates, thiophosphonates, salicylates, and naphthenates and other oil-soluble carboxylates of a metal, particularly the alkali or alkaline earth metals, e.g., barium, sodium, potassium, lithium, calcium, and magnesium. The most commonly used metals are calcium and magnesium, which may both be present in detergents used in a lubricant, and mixtures of calcium and/or magnesium with sodium. Combinations of detergents, whether overbased or neutral or both, may be used.

Sulfonates may be prepared from sulfonic acids which are typically obtained by the sulfonation of alkyl substituted aromatic hydrocarbons such as those obtained from the fractionation of petroleum or by the alkylation of aromatic hydrocarbons. Examples included those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety.

The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid with an appropriate metal compound such as an oxide or hydroxide and neutral or overbased products may be obtained by methods well known in the art. The aromatic moiety of the aromatic carboxylic acid can contain hetero atoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges. The carboxylic moiety may be attached directly or indirectly to the aromatic moiety. Preferably the carboxylic acid group is attached directly to a carbon atom on the aromatic moiety, such as a carbon atom on the benzene ring. More preferably, the aromatic moiety also contains a second functional group, such as a hydroxy group or a sulfonate group, which can be attached directly or indirectly to a carbon atom on the aromatic moiety.

Preferred examples of aromatic carboxylic acids are salicylic acids and sulfurized derivatives thereof, such as hydrocarbyl substituted salicylic acid and derivatives thereof. Processes for sulfurizing, for example a hydrocarbyl—substituted salicylic acid, are known to those skilled in the art. Salicylic acids are typically prepared by carboxylation, for example, by the Kolbe-Schmitt process, of phenoxides, and in that case, will generally be obtained, normally in a diluent, in admixture with uncarboxylated phenol.

Preferred substituents in oil-soluble salicylic acids are alkyl substituents. In alkyl—substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

Detergents generally useful in the formulation of lubricating oil compositions also include "hybrid" detergents formed with mixed surfactant systems, e.g., phenate/salicylates, sulfonate/phenates, sulfonate/salicylates, sulfonates/phenates/salicylates, as described, for example, in U.S. Pat. Nos. 6,153,565; 6,281,179; 6,429,178; and 6,429,178.

Lubricating oil compositions of the present invention contain at least about 0.2 mass % of magnesium, such as at least about 0.4 mass %, or at least about 0.5 mass % of magnesium sulfated ash based on the total mass of the lubricating oil composition, which is preferably introduced into the lubricating oil composition by use of one or more magnesium detergent, more preferably, at least one or more overbased magnesium detergents.

Overbased detergent (including overbased magnesium detergent and optionally, overbased detergent based on other metals such as calcium and/or sodium), is preferably used in an amount providing the lubricating oil composition with a TBN of from about 4 to about 10 mg KOH/g, preferably from about 5 to about 8 mg KOH/g. Overbased ash-containing detergents based on metals other than magnesium are present in amounts contributing no greater than 60%, such as no greater than 50% or no greater than 40% of the TBN of the lubricating oil composition contributed by overbased detergent. Preferably, lubricating oil compositions of the present invention contain calcium-based overbased ash-containing detergents in amounts providing no greater than about 40% of the total TBN contributed to the lubricating oil composition by overbased detergent. Combinations of overbased magnesium detergents may be used (e.g., an overbased magnesium salicylate and an overbased magnesium sulfonate; or two or more magnesium detergents each having a different TBN of greater than 150). Preferably, the overbased magnesium detergent will have, or have on average, a TBN of at least about 200, such as from about 200 to about 500; preferably at least about 250, such as from about 250 to about 500; more preferably at least about 300, such as from about 300 to about 450.

In addition to the required overbased magnesium detergent, lubricating oil compositions may contain neutral metal-containing detergents (having a TBN of less than 150). These neutral metal-based detergents may be magnesium salts or salts of other alkali or alkali earth metals, such as calcium. Where overbased or neutral detergents based on metals other than magnesium are employed, preferably at least about 30 mass %, more preferably at least about 40 mass %, particularly at least about 50 mass % of the total amount of metal introduced into the lubricating oil composition by detergent will be magnesium. Preferably, lubricating oil compositions useful in the practice of the method of the present invention will have a calcium sulfated ash content of less than 0.4 mass %, such as less than 0.3 mass % or less than 0.2 mass %, more preferably less than 0.1 mass %, based on the total mass of the lubricating oil composition.

Lubricating oil compositions of the present invention may also contain ashless (metal-free) detergents such as oil-soluble hydrocarbyl phenol aldehyde condensates described, for example, in US-2005-0277559-A1.

Preferably, detergent in total is used in an amount providing the lubricating oil composition with from about 0.35 to about 1.0 mass %, such as from about 0.5 to about 0.9 mass %, more preferably from about 0.6 to about 0.8 mass % of sulfated ash (SASH).

Dihydrocarbyl dithiophosphate metal salts are frequently used as antiwear and antioxidant agents. The metal may be an alkali or alkaline earth metal, or aluminum, lead, tin, molybdenum, manganese, nickel or copper. The zinc salts are most commonly used in lubricating oil in amounts of 0.1 to 10, preferably 0.2 to 2 mass %, based upon the total weight of the lubricating oil composition. They may be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid may be made by reacting mixtures of primary and secondary alcohols. Alternatively, multiple dithiophosphoric acids can be prepared where the hydrocarbyl groups on one are entirely secondary in character and the hydrocarbyl groups on the others are entirely primary in character. To make the zinc salt, any basic or neutral zinc compound could be used but the oxides, hydroxides and carbonates are most generally employed. Commercial additives frequently contain an excess of zinc due to the use of an excess of the basic zinc compound in the neutralization reaction.

The preferred zinc dihydrocarbyl dithiophosphates are oil soluble salts of dihydrocarbyl dithiophosphoric acids and may be represented by the following formula:

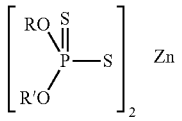

wherein R and R' may be the same or different hydrocarbyl radicals containing from 1 to 18, preferably 2 to 12, carbon atoms and including radicals such as alkyl, alkenyl, aryl, arylalkyl, alkaryl and cycloaliphatic radicals. Particularly preferred as R and R' groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-octyl, decyl, dodecyl, octadecyl, 2-ethylhexyl, phenyl, butylphenyl, cyclohexyl, methylcyclopentyl, propenyl, butenyl. In order to obtain oil solubility, the total number of carbon atoms (i.e. R and R') in the dithiophosphoric acid will generally be about 5 or greater. The zinc dihydrocarbyl dithiophosphate (ZDDP) can therefore comprise zinc dialkyl dithiophosphates. Lubricating oil compositions of the present invention have a phosphorous content of no greater than about 0.08 mass % (800 ppm). Preferably, in the practice of the present invention, ZDDP is used in an amount close or equal to the maximum amount allowed, preferably in an amount that provides a phosphorus content within 100 ppm of the maximum allowable amount of phosphorus. Thus, lubricating oil compositions useful in the practice of the present invention will preferably contain ZDDP or other zinc-phosphorus compounds, in an amount introducing from about 0.05 to about 0.08 mass % of phosphorus, such as from about 0.06 to about 0.08 mass % of phosphorus, preferably, from about 0.07 to about 0.08 mass % of phosphorus, based on the total mass of the lubricating oil composition.

Oxidation inhibitors or antioxidants reduce the tendency of mineral oils to deteriorate in service. Oxidative deterioration can be evidenced by sludge in the lubricant, varnish-like deposits on the metal surfaces, and by viscosity growth. Such oxidation inhibitors include hindered phenols, alkaline earth metal salts of alkylphenolthioesters having preferably $C_5$ to $C_{12}$ alkyl side chains, calcium nonylphenol sulfide, oil soluble phenates and sulfurized phenates, phosphosulfurized or sulfurized hydrocarbons or esters, phosphorous esters, metal thiocarbamates, oil soluble copper compounds as described in U.S. Pat. No. 4,867,890, and molybdenum-containing compounds.

Aromatic amines having at least two aromatic groups attached directly to the nitrogen constitute another class of compounds that is frequently used for antioxidancy. Typical oil soluble aromatic amines having at least two aromatic groups attached directly to one amine nitrogen contain from 6 to 16 carbon atoms. The amines may contain more than two aromatic groups. Compounds having a total of at least three aromatic groups in which two aromatic groups are linked by a covalent bond or by an atom or group (e.g., an oxygen or sulfur atom, or a —CO—, —$SO_2$— or alkylene group) and two are directly attached to one amine nitrogen also considered aromatic amines having at least two aromatic groups attached directly to the nitrogen. The aromatic rings are typically substituted by one or more substituents selected from alkyl, cycloalkyl, alkoxy, aryloxy, acyl, acylamino, hydroxy, and nitro groups. The amount of any such oil soluble aromatic amines having at least two aromatic groups attached directly to one amine nitrogen should preferably not exceed 0.4 mass %.

Dispersants maintain in suspension materials resulting from oxidation during use that are insoluble in oil, thus preventing sludge flocculation and precipitation, or deposition on metal parts. The lubricating oil composition of the present invention comprises at least one dispersant, and may comprise a plurality of dispersants. The dispersant or dispersants are preferably nitrogen-containing dispersants and preferably contribute, in total, from about 0.08 to about 0.19 mass %, such as from about 0.09 to about 0.18 mass %, most preferably from about 0.09 to about 0.16 mass % of nitrogen to the lubricating oil composition.

Dispersants useful in the context of the present invention include the range of nitrogen-containing, ashless (metal-free) dispersants known to be effective to reduce formation of deposits upon use in gasoline and diesel engines, when added to lubricating oils and comprise an oil soluble polymeric long chain backbone having functional groups capable of associating with particles to be dispersed. Typically, such dispersants have amine, amine-alcohol or amide polar moieties attached to the polymer backbone, often via a bridging group. The ashless dispersant may be, for example, selected from oil soluble salts, esters, amino-esters, amides, imides and oxazolines of long chain hydrocarbon-substituted mono- and polycarboxylic acids or anhydrides thereof; thiocarboxylate derivatives of long chain hydrocarbons; long chain aliphatic hydrocarbons having polyamine moieties attached directly thereto; and Mannich condensation products formed by condensing a long chain substituted phenol with formaldehyde and polyalkylene polyamine.

Generally, each mono- or dicarboxylic acid-producing moiety will react with a nucleophilic group (amine or amide) and the number of functional groups in the polyalkenyl-substituted carboxylic acylating agent will determine the number of nucleophilic groups in the finished dispersant.

The polyalkenyl moiety of the dispersant of the present invention has a number average molecular weight of from about 700 to about 3000, preferably between 950 and 3000, such as between 950 and 2800, more preferably from about 950 to 2500, and most preferably from about 950 to about 2400. In one embodiment of the invention, the dispersant comprises a combination of a lower molecular weight dispersant (e.g., having a number average molecular weight of from about 700 to 1100) and a high molecular weight dispersant having a number average molecular weight of from about at least about 1500, preferably between 1800 and 3000, such as between 2000 and 2800, more preferably from about 2100 to 2500, and most preferably from about 2150 to about 2400. The molecular weight of a dispersant is generally expressed in terms of the molecular weight of the polyalkenyl moiety as the precise molecular weight range of the dispersant depends on numerous parameters including the type of polymer used to derive the dispersant, the number of functional groups, and the type of nucleophilic group employed.

The polyalkenyl moiety from which the high molecular weight dispersants are derived preferably have a narrow molecular weight distribution (MWD), also referred to as polydispersity, as determined by the ratio of weight average molecular weight ($M_w$) to number average molecular weight ($M_n$). Specifically, polymers from which the dispersants of the present invention are derived have a $M_w/M_n$ of from about 1.5 to about 2.0, preferably from about 1.5 to about 1.9, most preferably from about 1.6 to about 1.8.

Suitable hydrocarbons or polymers employed in the formation of the dispersants of the present invention include homopolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. Therefore, useful alpha-olefin monomers and comonomers include, for example, propylene, butene-1, hexene-1, octene-1, 4-methylpentene-1, decene-1, dodecene-1, tridecene-1, tetradecene-1, pentadecene-1, hexadecene-1, heptadecene-1, octadecene-1, nonadecene-1, and mixtures thereof (e.g., mixtures of propylene and butene-1, and the like). Exemplary of such polymers are propylene homopolymers, butene-1 homopolymers, ethylene-propylene copolymers, ethylene-butene-1 copolymers, propylene-butene copolymers and the like, wherein the polymer contains at least some terminal and/or internal unsaturation. Preferred polymers are unsaturated copolymers of ethylene and propylene and ethylene and butene-1. The interpolymers of this invention may contain a minor amount, e.g. 0.5 to 5 mole % of a $C_4$ to $C_{18}$ non-conjugated diolefin comonomer. However, it is preferred that the polymers of this invention comprise only alpha-olefin homopolymers, interpolymers of alpha-olefin comonomers and interpolymers of ethylene and alpha-olefin comonomers. The molar ethylene content of the polymers employed in this invention is preferably in the range of 0 to 80%, and more preferably 0 to 60%. When propylene and/or butene-1 are employed as comonomer(s) with ethylene, the ethylene content of such copolymers is most preferably between 15 and 50%, although higher or lower ethylene contents may be present.

These polymers may be prepared by polymerizing alpha-olefin monomer, or mixtures of alpha-olefin monomers, or mixtures comprising ethylene and at least one $C_3$ to $C_{28}$ alpha-olefin monomer, in the presence of a catalyst system comprising at least one metallocene (e.g., a cyclopentadienyl-transition metal compound) and an alumoxane compound. Using this process, a polymer in which 95% or more of the polymer chains possess terminal ethenylidene-type unsaturation can be provided. The percentage of polymer chains exhibiting terminal ethenylidene unsaturation may be determined by FTIR spectroscopic analysis, titration, or $C^{13}$ NMR. Interpolymers of this latter type may be characterized by the formula POLY-C($R^1$)=$CH_2$ wherein $R^1$ is $C_1$ to $C_{26}$ alkyl, preferably $C_1$ to $C_{18}$ alkyl, more preferably $C_1$ to $C_8$ alkyl, and most preferably $C_1$ to $C_2$ alkyl, (e.g., methyl or ethyl) and wherein POLY represents the polymer chain. The chain length of the $R^1$ alkyl group will vary depending on the comonomer(s) selected for use in the polymerization. A minor amount of the polymer chains can contain terminal ethenyl, i.e., vinyl, unsaturation, i.e. POLY-CH=$CH_2$, and a portion of the polymers can contain internal monounsaturation, e.g. POLY-CH=CH($R^1$), wherein $R^1$ is as defined above. These terminally unsaturated interpolymers may be prepared by known metallocene chemistry and may also be prepared as described in U.S. Pat. Nos. 5,498,809; 5,663,130; 5,705,577; 5,814,715; 6,022,929 and 6,030,930.

Another useful class of polymers is polymers prepared by cationic polymerization of isobutene, styrene, and the like. Common polymers from this class include polyisobutenes obtained by polymerization of a $C_4$ refinery stream having a butene content of about 35 to about 75 mass %, and an isobutene content of about 30 to about 60 mass %, in the presence of a Lewis acid catalyst, such as aluminum trichloride or boron trifluoride. A preferred source of monomer for making poly-n-butenes is petroleum feedstreams such as Raffinate II. These feedstocks are disclosed in the art such as in U.S. Pat. No. 4,952,739. Polyisobutylene is a most preferred backbone of the present invention because it is readily available by cationic polymerization from butene streams (e.g., using $AlCl_3$ or $BF_3$ catalysts). Such polyisobutylenes generally contain residual unsaturation in amounts of about one ethylenic double bond per polymer chain, positioned along the chain. A preferred embodiment utilizes polyisobutylene prepared from a pure isobutylene stream or a Raffinate I stream to prepare reactive isobutylene polymers with terminal vinylidene olefins. Preferably, these polymers, referred to as highly reactive polyisobutylene (HR-PIB), have a terminal vinylidene content of at least 65%, e.g., 70%, more preferably at least 80%, most preferably, at least 85%. The preparation of such polymers is described, for example, in U.S. Pat. No. 4,152,499. HR-PIB is known and HR-PIB is commercially available under the tradenames Glissopal™ (from BASF) and Ultravis™ (from BP-Amoco).

Polyisobutylene polymers that may be employed are generally based on a hydrocarbon chain of from about 700 to 3000. Methods for making polyisobutylene are known. Polyisobutylene can be functionalized by halogenation (e.g. chlorination), the thermal "ene" reaction, or by free radical grafting using a catalyst (e.g. peroxide), as described below.

The hydrocarbon or polymer backbone can be functionalized, e.g., with carboxylic acid producing moieties (preferably acid or anhydride moieties) selectively at sites of carbon-to-carbon unsaturation on the polymer or hydrocarbon chains, or randomly along chains using any of the three processes mentioned above or combinations thereof, in any sequence.

Processes for reacting polymeric hydrocarbons with unsaturated carboxylic acids, anhydrides or esters and the preparation of derivatives from such compounds are disclosed in U.S. Pat. Nos. 3,087,936; 3,172,892; 3,215,707; 3,231,587; 3,272,746; 3,275,554; 3,381,022; 3,442,808; 3,565,804; 3,912,764; 4,110,349; 4,234,435; 5,777,025; 5,891,953; as well as EP 0 382 450 B1; CA-1,335,895 and GB-A1,440,219. The polymer or hydrocarbon may be functionalized, for example, with carboxylic acid producing moieties (preferably acid or anhydride) by reacting the polymer or hydrocarbon under conditions that result in the addition of functional moieties or agents, i.e., acid, anhydride, ester moieties, etc., onto the polymer or hydrocarbon chains primarily at sites of carbon-to-carbon unsaturation (also referred to as ethylenic or olefinic unsaturation) using the halogen assisted functionalization (e.g. chlorination) process or the thermal "ene" reaction.

Selective functionalization can be accomplished by halogenating, e.g., chlorinating or brominating the unsaturated α-olefin polymer to about 1 to 8 mass %, preferably 3 to 7 mass % chlorine, or bromine, based on the weight of polymer or hydrocarbon, by passing the chlorine or bromine through the polymer at a temperature of 60 to 250° C., preferably 110 to 160° C., e.g., 120 to 140° C., for about 0.5 to 10, preferably 1 to 7 hours. The halogenated polymer or hydrocarbon (hereinafter backbone) is then reacted with sufficient monounsaturated reactant capable of adding the required number of functional moieties to the backbone, e.g., monounsaturated carboxylic reactant, at 100 to 250° C., usually about 180° C. to 235° C., for about 0.5 to 10, e.g., 3 to 8 hours, such that the product obtained will contain the desired number of moles of the monounsaturated carboxylic reactant per mole of the halogenated backbones. Alternatively, the backbone and the monounsaturated carboxylic reactant are mixed and heated while adding chlorine to the hot material.

While chlorination normally helps increase the reactivity of starting olefin polymers with monounsaturated functionalizing reactant, it is not necessary with some of the polymers or hydrocarbons contemplated for use in the present invention, particularly those preferred polymers or hydrocarbons which possess a high terminal bond content and reactivity. Preferably, therefore, the backbone and the monounsaturated functionality reactant, e.g., carboxylic reactant, are contacted at elevated temperature to cause an initial thermal "ene" reaction to take place. Ene reactions are known.

The hydrocarbon or polymer backbone can be functionalized by random attachment of functional moieties along the polymer chains by a variety of methods. For example, the polymer, in solution or in solid form, may be grafted with the monounsaturated carboxylic reactant, as described above, in the presence of a free-radical initiator. When performed in solution, the grafting takes place at an elevated temperature in the range of about 100 to 260° C., preferably 120 to 240° C. Preferably, free-radical initiated grafting would be accomplished in a mineral lubricating oil solution containing, e.g., 1 to 50 mass %, preferably 5 to 30 mass % polymer based on the initial total oil solution.

The free-radical initiators that may be used are peroxides, hydroperoxides, and azo compounds, preferably those that have a boiling point greater than about 100° C. and decompose thermally within the grafting temperature range to provide free-radicals. Representative of these free-radical initiators are azobutyronitrile, 2,5-dimethylhex-3-ene-2,5-bis-tertiary-butyl peroxide and dicumene peroxide. The initiator, when used, typically is used in an amount of between 0.005% and 1% by weight based on the weight of the reaction mixture solution. Typically, the aforesaid monounsaturated carboxylic reactant material and free-radical initiator are used in a weight ratio range of from about 1.0:1 to 30:1, preferably 3:1 to 6:1. The grafting is preferably carried out in an inert atmosphere, such as under nitrogen blanketing. The resulting grafted polymer is characterized by having carboxylic acid (or ester or anhydride) moieties randomly attached along the polymer chains: it being understood, of course, that some of the polymer chains remain ungrafted. The free radical grafting described above can be used for the other polymers and hydrocarbons of the present invention.

The preferred monounsaturated reactants that are used to functionalize the backbone comprise mono- and dicarboxylic acid material, i.e., acid, anhydride, or acid ester material, including (i) monounsaturated $C_4$ to $C_{10}$ dicarboxylic acid wherein (a) the carboxyl groups are vicinyl, (i.e., located on adjacent carbon atoms) and (b) at least one, preferably both, of said adjacent carbon atoms are part of said mono unsaturation; (ii) derivatives of (i) such as anhydrides or $C_1$ to $C_5$ alcohol derived mono- or diesters of (i); (iii) monounsaturated $C_3$ to $C_{10}$ monocarboxylic acid wherein the carbon-carbon double bond is conjugated with the carboxy group, i.e., of the structure —C═C—CO—; and (iv) derivatives of (iii) such as $C_1$ to $C_5$ alcohol derived mono- or diesters of (iii). Mixtures of monounsaturated carboxylic materials (i)-(iv) also may be used. Upon reaction with the backbone, the monounsaturation of the monounsaturated carboxylic reactant becomes saturated. Thus, for example, maleic anhydride becomes backbone-substituted succinic anhydride, and acrylic acid becomes backbone-substituted propionic acid. Exemplary of such monounsaturated carboxylic reactants are fumaric acid, itaconic acid, maleic acid, maleic anhydride, chloromaleic acid, chloromaleic anhydride, acrylic acid, methacrylic acid, crotonic acid, cinnamic acid, and lower alkyl (e.g., $C_1$ to $C_4$ alkyl) acid esters of the foregoing, e.g., methyl maleate, ethyl fumarate, and methyl fumarate.

To provide the required functionality, the monounsaturated carboxylic reactant, preferably maleic anhydride, typically will be used in an amount ranging from about equimolar amount to about 100 mass % excess, preferably 5 to 50 mass % excess, based on the moles of polymer or hydrocarbon. Unreacted excess monounsaturated carboxylic reactant can be removed from the final dispersant product by, for example, stripping, usually under vacuum, if required.

The functionalized oil-soluble polymeric hydrocarbon backbone is then derivatized with a nitrogen-containing nucleophilic reactant, such as an amine, amino-alcohol, amide, or mixture thereof, to form a corresponding derivative. Amine compounds are preferred. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g., polyalkene and polyoxyalkylene polyamines of about 2 to 60, such as 2 to 40 (e.g., 3 to 20) total carbon atoms having about 1 to 12, such as 3 to 12, preferably 3 to 9, most preferably form about 6 to about 7 nitrogen atoms per molecule. Mixtures of amine compounds may advantageously be used, such as those prepared by reaction of alkylene dihalide with ammonia. Preferred amines are aliphatic saturated amines, including, for example, 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine. Such polyamine mixtures, known as PAM, are commercially available. Particularly preferred polyamine mixtures are mixtures derived by distilling the light ends from PAM products. The resulting mixtures, known as "heavy" PAM, or HPAM, are also commercially available. The properties and attributes of both PAM and/or HPAM are described, for example, in U.S. Pat. Nos. 4,938,881; 4,927,551; 5,230,714; 5,241,003; 5,565,128; 5,756,431; 5,792,730; and 5,854,186.

Other useful amine compounds include: alicyclic diamines such as 1,4-di(aminomethyl)cyclohexane and heterocyclic nitrogen compounds such as imidazolines. Another useful class of amines is the polyamido and related amido-amines as disclosed in U.S. Pat. Nos. 4,857,217; 4,956,107; 4,963,275; and 5,229,022. Also usable is tris (hydroxymethyl)amino methane (TAM) as described in U.S. Pat. Nos. 4,102,798; 4,113,639; 4,116,876; and UK 989,409. Dendrimers, star-like amines, and comb-structured amines may also be used. Similarly, one may use condensed amines, as described in U.S. Pat. No. 5,053,152. The functionalized polymer is reacted with the amine compound using conventional techniques as described, for example, in U.S. Pat. Nos. 4,234,435 and 5,229,022, as well as in EP-A-208,560.

A preferred dispersant composition is one comprising at least one polyalkenyl succinimide, which is the reaction product of a polyalkenyl substituted succinic anhydride (e.g., PIBSA) and a polyamine (PAM) that has a coupling ratio of from about 0.65 to about 1.25, preferably from about 0.8 to about 1.1, most preferably from about 0.9 to about 1. In the context of this disclosure, "coupling ratio" may be defined as a ratio of the number of succinyl groups in the PIBSA to the number of primary amine groups in the polyamine reactant.

Another class of high molecular weight ashless dispersants comprises Mannich base condensation products. Generally, these products are prepared by condensing about one mole of a long chain alkyl-substituted mono- or polyhydroxy benzene with about 1 to 2.5 moles of carbonyl compound(s) (e.g., formaldehyde and paraformaldehyde) and about 0.5 to 2 moles of polyalkylene polyamine, as disclosed, for example, in U.S. Pat. No. 3,442,808. Such Mannich base condensation products may include a polymer product of a metallocene catalyzed polymerization as a substituent on the benzene group, or may be reacted with a compound containing such a polymer substituted on a succinic anhydride in a manner similar to that described in U.S. Pat. No. 3,442,808. Examples of functionalized and/or derivatized olefin polymers synthesized using metallocene catalyst systems are described in the publications identified supra.

The dispersant(s) of the present invention are preferably non-polymeric (e.g., are mono- or bis-succinimides).

The dispersant(s) of the present invention, particularly the lower molecular weight dispersants, may optionally be borated. Such dispersants can be borated by conventional means, as generally taught in U.S. Pat. Nos. 3,087,936, 3,254,025 and 5,430,105. Boration of the dispersant is readily accomplished by treating an acyl nitrogen-containing dispersant with a boron compound such as boron oxide, boron halide boron acids, and esters of boron acids, in an amount sufficient to provide from about 0.1 to about 20 atomic proportions of boron for each mole of acylated nitrogen composition.

Dispersants derived from highly reactive polyisobutylene have been found to provide lubricating oil compositions with a wear credit relative to a corresponding dispersant derived from conventional polyisobutylene. This wear credit is of particular importance in lubricants containing reduced levels of ash-containing antiwear agents, such as ZDDP. Thus, in one preferred embodiment, at least one dispersant used in the lubricating oil compositions of the present invention is derived from highly reactive polyisobutylene.

Additional additives may be incorporated into the compositions of the invention to enable particular performance requirements to be met. Examples of additives which may be included in the lubricating oil compositions of the present invention are metal rust inhibitors, viscosity index improvers, corrosion inhibitors, oxidation inhibitors, friction modifiers, anti-foaming agents, anti-wear agents and pour point depressants. Some are discussed in further detail below.

Friction modifiers and fuel economy agents that are compatible with the other ingredients of the final oil may also be included. Examples of such materials include glyceryl monoesters of higher fatty acids, for example, glyceryl mono-oleate; esters of long chain polycarboxylic acids with diols, for example, the butane diol ester of a dimerized unsaturated fatty acid; oxazoline compounds; and alkoxylated alkyl-substituted mono-amines, diamines and alkyl ether amines, for example, ethoxylated tallow amine and ethoxylated tallow ether amine.

Other known friction modifiers comprise oil-soluble organo-molybdenum compounds. Such organo-molybdenum friction modifiers also provide antioxidant and antiwear credits to a lubricating oil composition. Examples of such oil soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkaline metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention are organo-molybdenum compounds of the formula $$Mo(ROCS_2)_4 \text{ and}$$

$$Mo(RSCS_2)_4$$

wherein R is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms should be present among all the ligand organo groups, such as at least 25, at least 30, or at least 35 carbon atoms.

Lubricating oil compositions useful in the practice of the method of the present invention preferably contain from about 10 to about 1000 ppm, such as 30 to about 750 ppm, or 40 to about 500 ppm of molybdenum (measured as atoms of molybdenum).

The viscosity index of the base stock is increased, or improved, by incorporating therein certain polymeric materials that function as viscosity modifiers (VM) or viscosity index improvers (VII). Generally, polymeric materials useful as viscosity modifiers are those having number average molecular weights (Mn) of from about 5,000 to about 250,000, preferably from about 15,000 to about 200,000, more preferably from about 20,000 to about 150,000. These viscosity modifiers can be grafted with grafting materials such as, for example, maleic anhydride, and the grafted material can be reacted with, for example, amines, amides, nitrogen-containing heterocyclic compounds or alcohol, to form multifunctional viscosity modifiers (dispersant-viscosity modifiers). Polymer molecular weight, specifically $\overline{M}_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method for determining molecular weight, particularly for lower molecular weight polymers, is vapor pressure osmometry (see, e.g., ASTM D3592).

One class of diblock copolymers useful as viscosity modifiers has been found to provide a wear credit relative to, for example, olefin copolymer viscosity modifiers. This wear credit is of particular importance in lubricants containing reduced levels of ash-containing antiwear agents, such as ZDDP. Thus, in one preferred embodiment, at least one viscosity modifier used in the lubricating oil compositions of the present invention is a linear diblock copolymer comprising one block derived primarily, preferably predominantly, from vinyl aromatic hydrocarbon monomer, and one block derived primarily, preferably predominantly, from diene monomer. Useful vinyl aromatic hydrocarbon monomers include those containing from 8 to about 16 carbon atoms such as aryl-substituted styrenes, alkoxy-substituted styrenes, vinyl naphthalene, alkyl-substituted vinyl naphthalenes and the like. Dienes, or diolefins, contain two double bonds, commonly located in conjugation in a 1,3 relationship. Olefins containing more than two double bonds, sometimes referred to as polyenes, are also considered within the definition of "diene" as used herein. Useful dienes include those containing from 4 to about 12 carbon atoms, preferably from 8 to about 16 carbon atoms, such as 1,3-butadiene, isoprene, piperylene, methylpentadiene, phenylbutadiene, 3,4-dimethyl-1,3-hexadiene, 4,5-diethyl-1,3-octadiene, with 1,3-butadiene and isoprene being preferred.

As used herein in connection with polymer block composition, "predominantly" means that the specified monomer or monomer type that is the principle component in that polymer block is present in an amount of at least 85% by weight of the block.

Polymers prepared with diolefins will contain ethylenic unsaturation, and such polymers are preferably hydrogenated. When the polymer is hydrogenated, the hydrogenation may be accomplished using any of the techniques known in the prior art. For example, the hydrogenation may be accomplished such that both ethylenic and aromatic unsaturation is converted (saturated) using methods such as those taught, for example, in U.S. Pat. Nos. 3,113,986 and 3,700,633 or the hydrogenation may be accomplished selectively such that a significant portion of the ethylenic unsaturation is converted while little or no aromatic unsaturation is converted as taught, for example, in U.S. Pat. Nos. 3,634,595; 3,670,054; 3,700,633 and Re 27,145. Any of these methods can also be used to hydrogenate polymers containing only ethylenic unsaturation and which are free of aromatic unsaturation.

The block copolymers may include mixtures of linear diblock polymers as disclosed above, having different molecular weights and/or different vinyl aromatic contents as well as mixtures of linear block copolymers having different molecular weights and/or different vinyl aromatic contents. The use of two or more different polymers may be preferred to a single polymer depending on the rheological properties the product is intended to impart when used to produce formulated engine oil. Examples of commercially available styrene/hydrogenated isoprene linear diblock copolymers include Infineum SV140™, Infineum SV150™ and Infineum SV160™, available from Infineum USA L.P. and Infineum UK Ltd.; Lubrizol® 7318, available from The Lubrizol Corporation; and Septon 1001™ and Septon 1020™, available from Septon Company of America (Kuraray Group). Suitable styrene/1,3-butadiene hydrogenated block copolymers are sold under the tradename Glissoviscal™ by BASF.

Pour point depressants (PPD), otherwise known as lube oil flow improvers (LOFIs) lower the temperature. Compared to VM, LOFIs generally have a lower number average molecular weight. Like VM, LOFIs can be grafted with grafting materials such as, for example, maleic anhydride, and the grafted material can be reacted with, for example, amines, amides, nitrogen-containing heterocyclic compounds or alcohol, to form multifunctional additives.

In the present invention it may be necessary to include an additive which maintains the stability of the viscosity of the blend. Thus, although polar group-containing additives achieve a suitably low viscosity in the pre-blending stage it has been observed that some compositions increase in viscosity when stored for prolonged periods. Additives which are effective in controlling this viscosity increase include the long chain hydrocarbons functionalized by reaction with mono- or dicarboxylic acids or anhydrides which are used in the preparation of the ashless dispersants as hereinbefore disclosed. In another preferred embodiment, the lubricating oil compositions of the present invention contain an effective amount of a long chain hydrocarbons functionalized by reaction with mono- or dicarboxylic acids or anhydrides.

When lubricating compositions contain one or more of the above-mentioned additives, each additive is typically blended into the base oil in an amount that enables the additive to provide its desired function. Representative effective amounts of such additives, when used in crankcase lubricants, are listed below. All the values listed (with the exception of detergent values) are stated as mass percent active ingredient (A.I.).

| ADDITIVE | MASS % (Broad) | MASS % (Preferred) |
|---|---|---|
| Dispersant | 0.1-20 | 1-8 |
| Metal Detergents | 0.1-15 | 0.2-9 |
| Corrosion Inhibitor | 0-5 | 0-1.5 |
| Metal Dihydrocarbyl Dithiophosphate | 0.1-6 | 0.1-4 |
| Antioxidant | 0-5 | 0.01-2.5 |
| Pour Point Depressant | 0.01-5 | 0.01-1.5 |
| Antifoaming Agent | 0-5 | 0.001-0.15 |

-continued

| ADDITIVE | MASS % (Broad) | MASS % (Preferred) |
|---|---|---|
| Supplemental Antiwear Agents | 0-1.0 | 0-0.5 |
| Friction Modifier | 0-5 | 0-1.5 |
| Viscosity Modifier | 0.01-10 | 0.25-3 |
| Base stock | Balance | Balance |

Preferably, the Noack volatility of the fully formulated lubricating oil composition (oil of lubricating viscosity plus all additives) will be no greater than 20 mass %, such as no greater than 15 mass %, preferably no greater than 13 mass %. Lubricating oil compositions useful in the practice of the present invention may have an overall sulfated ash content of from about 0.3 to about 1.2 mass %, such as from about 0.4 to about 1.1 mass %, preferably from about 0.5 to about 1.0 mass %.

It may be desirable, although not essential to prepare one or more additive concentrates comprising additives (concentrates sometimes being referred to as additive packages) whereby several additives can be added simultaneously to the oil to form the lubricating oil composition.

The final composition may employ from 5 to 25 mass %, preferably 5 to 22 mass %, typically 10 to 20 mass % of the concentrate, the remainder being oil of lubricating viscosity.

This invention will be further understood by reference to the following examples, wherein all parts are parts by mass, unless otherwise noted and which include preferred embodiments of the invention.

EXAMPLES

In the following Examples, data regarding LSPI occurrences was generated using a turbocharged, direct injected, GM Ecotec 2.0 liter, 4 cylinder engine, the boost level of which was modified to generate a break mean effective pressure level of about 23 bar, at an engine speed of about 2000 rpm. For each cycle (a cycle being 2 piston cycles (up/down, up/down), data was collected at 0.5° crank angle resolution. Post processing of the data included calculation of combustion metrics, verification of operating parameters being within target limits, and detection of LSPI events (statistical procedure outlined below). From the above data, outliers, which are potential occurrences of LSPI were collected. For each LSPI cycle, data recorded included peak pressure (PP), MFB02 (crank angle at 2% mass fraction burned), as well as other mass fractions (10%, 50% and 90%), cycle number and engine cylinder. A cycle was identified as having an LSPI event if either or both of the crank angle corresponding to MFB02 of the fuel and the cylinder PP are outliers. Outliers were determined relative to the distribution of a particular cylinder and test segment in which it occurs. Determination of "outliers" was an iterative process involving calculation of the mean and standard deviation of PP and MFB02 for each segment and cylinder; and cycles with parameters that exceed n standard deviations from the mean. The number of standard deviations n, used as a limit for determining outliers, is a function of the number of cycles in the test and was calculated using the Grubbs' test for outliers. Outliers were identified in the severe tail of each distribution. That is, if n is the number of standard deviations obtained from Grubbs' test for outliers, an outlier for PP is identified as one exceeding the mean plus n standard deviations of peak pressure. Likewise, an outlier for MFB02 was identified as one being lower than the mean less n standard deviations of MFB02. Data was further examined to ensure that the outliers indicated an occurrence of LSPI, rather than some other abnormal combustion event of an electrical sensor error.

An LSPI "event" was taken as one in which there were three "normal" cycles both before and after. While this method was used here, it is not part of the present invention. Studies conducted by others have counted each individual cycle, whether or not it is part of a multiple cycle event. The present definition of an LSPI event is shown in FIG. 1 wherein 1 represents a single LSPI event because each event was not preceded and followed by three normal events; 2 represents three normal events, and 3 represents a second LSPI event. The LSPI trigger level is represented by 4.

A series of 5W-30 grade lubricating oil compositions representing typical passenger car motor oils meeting the GF-4 specification were prepared. These compositions contained typical and identical types and amounts of basestock, dispersant, ashless antioxidant, ZDDP, ashless friction modifier and other performance additives, and varied amounts of either a 200 TBN calcium sulfonate detergent or a 400 TBN magnesium sulfonate detergent. The type/amount (total including diluent oil, not A.I.) of detergent, metal content (reported as sulfated ash) and phosphorus content of each of the compositions is shown below, in Table 2:

TABLE 2

| | Ex. 1 | Ex. 2 | Ex. 3 | Ex. 4 | Ex. 5 | Ex. 6 | Ex. 7 | Ex. 8 | Ex. 9 | Ex. 10 |
|---|---|---|---|---|---|---|---|---|---|---|
| Det. Type | CaSul | CaSul | CaSul | CaSul | CaSul | MgSul | MgSul | MgSul | MgSul | MgSul |
| Det. Amt (m %) | 0.800 | 1.200 | 1.600 | 2.000 | 2.400 | 0.800 | 1.200 | 1.600 | 2.000 | 2.400 |
| Ash (m %) | 0.428 | 0.574 | 0.721 | 0.867 | 1.013 | 0.424 | 0.567 | 0.711 | 0.855 | 0.999 |
| Ca (m %) | 0.094 | 0.141 | 0.187 | 0.234 | 0.280 | 0.002 | 0.002 | 0.002 | 0.002 | 0.002 |
| Mg (m %) | — | — | — | — | — | 0.073 | 0.109 | 0.146 | 0.182 | 0.218 |
| P (m %) | 0.054 | 0.054 | 0.054 | 0.054 | 0.054 | 0.054 | 0.054 | 0.054 | 0.054 | 0.054 |
| Zn (m %) | 0.060 | 0.060 | 0.060 | 0.060 | 0.060 | 0.060 | 0.060 | 0.060 | 0.060 | 0.060 |

Using the turbocharged, direct injected, GM Ecotec 2.0 liter, 4 cylinder engine described above, a four hour engine test including two sets of 25,000 cycle segments in which the engine was operated at about 23 bar/2000 rpm, separated by a set of two 25,000 cycle segments in which the engine was operated at about 14 bar/1400 rpm was run using each of the above-identified lubricating oil compositions. For each test, data collected during the two segments in which the engine was operated at about 23 bar/2000 rpm was analyzed to determine the frequency of LSPI occurrences. The results are shown in FIG. 1 (Ex. 1-5) and FIG. 2 (Ex. 6-10).

Figure 2:
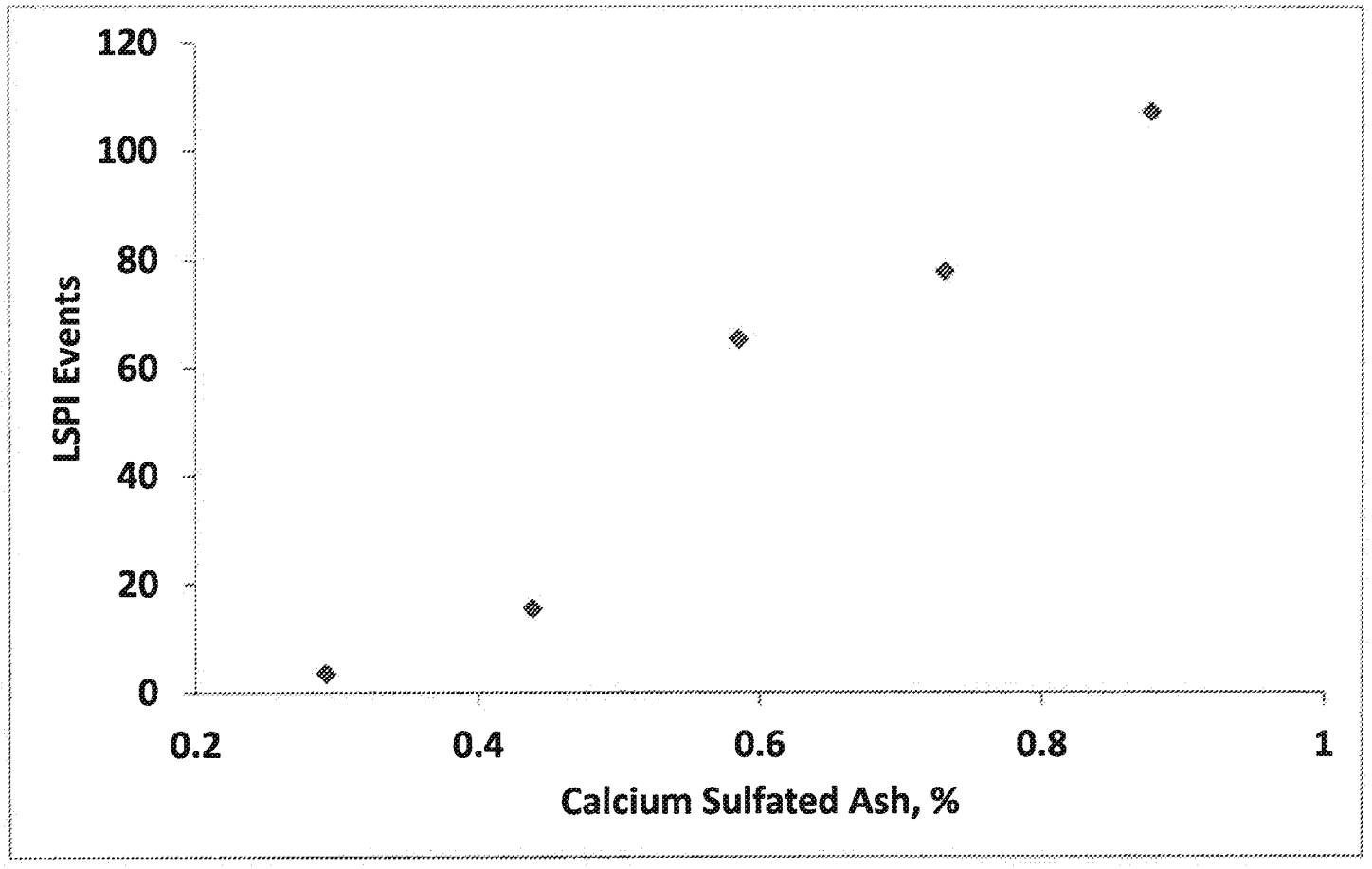
FIG. 2 plots the average occurrence of LSPI events vs. calcium sulfated ash content, in a turbocharged, direct injected, GM Ecotec 2.0 liter, 4 cylinder engine, boosted to generate a break mean effective pressure level of about 18 bar, at an engine speed of about 2000 rpm, lubricated with a lubricating oil composition prepared using calcium overbased detergent.
Figure 3:
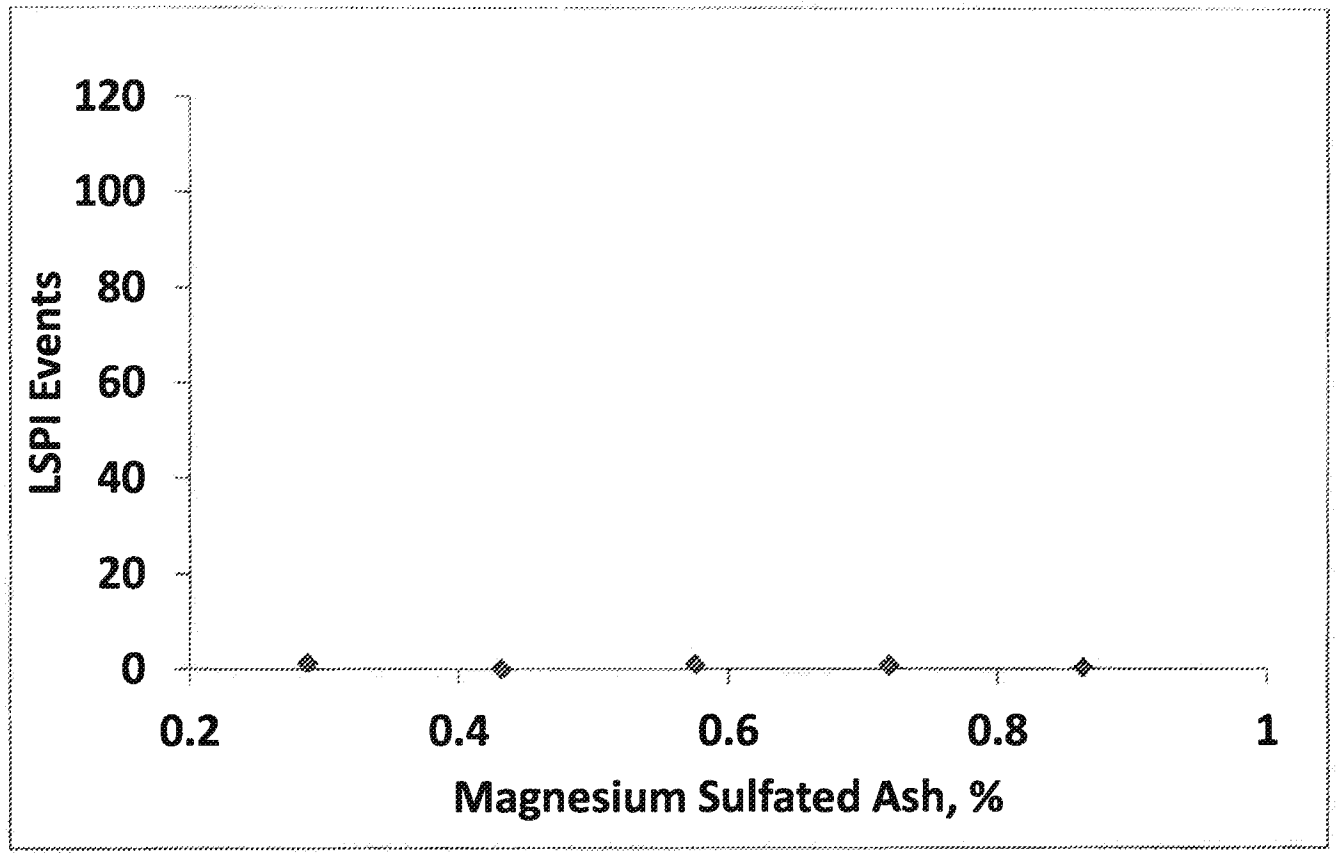
FIG. 3 plots the average occurrence of LSPI events vs. magnesium sulfated ash content, in a turbocharged, direct injected, GM Ecotec 2.0 liter, 4 cylinder engine, boosted to generate a break mean effective pressure level of about 18 bar, at an engine speed of about 2000 rpm lubricated with a lubricating oil composition prepared using magnesium overbased detergent

As shown by the results plotted in FIG. 1 and FIG. 2, LSPI events were detected with lubricating oil compositions having even very minor levels of calcium sulfated ash and the occurrence of LSPI increased steadily as the level of calcium sulfated ash in the lubricating oil increased. In contrast, the use of a lubricating oil composition containing magnesium sulfated ash was found to effectively ameliorate the occurrence of LSPI events.

The disclosures of all patents, articles and other materials described herein are hereby incorporated, in their entirety, into this specification by reference. Compositions described as "comprising" a plurality of defined components are to be construed as including compositions formed by admixing the defined plurality of defined components. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

What is claimed is:

1. A method of preventing or reducing the occurrence of Low Speed Pre-Ignition (LSPI) in a direct-injected, boosted, spark-ignited internal combustion engine that, in operation, generates a break mean effective pressure level of greater than about 15 bar, at an engine speed of from about 1500 to about 2500 rotations per minute (rpm) that is susceptible to the occurrence of LSPI, which method comprises the step of lubricating the crankcase of the engine with a lubricating oil composition having a total sulfated ash content of no greater than about 1.2 mass %, based on the total mass of the composition, said composition comprising an amount of a zinc-phosphorus compound providing said composition with a phosphorus content of from about 0.05 to about 0.08 mass %, based on the total mass of the composition, a magnesium detergent in an amount providing said composition with at least about 0.3 mass %, based on the total mass of the lubricating oil composition, of magnesium sulfated ash, and an amount of calcium detergent, or calcium and sodium detergent, providing said composition with from about 0.3 to about 0.4 mass %, based on the total mass of the lubricating oil composition, of calcium sulfated ash, or calcium and sodium sulfated ash, wherein the total amount of sulfated ash provided to said composition from detergent is no greater than 1.0 mass %, based on the total mass of the lubricating oil composition: and at least 40 mass % of the total amount of metal introduced into said lubricating oil composition by metal detergent is magnesium, and wherein said zinc phosphorus compound is zinc dihydrocarbyl dithiophosphate derived from secondary alcohol, or primary and secondary alcohol.

2. A method, as claimed in claim 1, wherein said engine generates a break mean effective pressure level of greater than about 20 bar, at an engine speed of from about 1500 to about 2500 (rpm).

3. A method, as claimed in claim 1, wherein said engine generates a break mean effective pressure level of greater than about 15 bar, at an engine speed of from about 1500 to about 2000.

4. A method, as claimed in claim 1, wherein said lubricating oil composition further contains said zinc phosphorus compound in an amount introducing from about 700 to about 800 ppm of phosphorus.

5. A method, as claimed in claim 1, wherein said lubricating oil composition further contains at least 50 ppm of molybdenum, based on the total mass of the lubricating oil composition.

6. A method, as claimed in claim 1, wherein said lubricating oil composition further comprises a borated dispersant.

* * * * *